US008840214B2

(12) United States Patent
de Jong et al.

(10) Patent No.: US 8,840,214 B2
(45) Date of Patent: Sep. 23, 2014

(54) EXCESSIVE SUBSTRATE MEDIA HEIGHT DETECTION IN A PRINTING APPARATUS

(75) Inventors: Joannes N. M. de Jong, Hopewell Junction, NY (US); Thomas J. Wyble, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 232 days.

(21) Appl. No.: 13/431,695

(22) Filed: Mar. 27, 2012

(65) Prior Publication Data

US 2013/0257956 A1 Oct. 3, 2013

(51) Int. Cl.
*B41J 29/38* (2006.01)
*B41J 29/393* (2006.01)
*B41J 2/01* (2006.01)

(52) U.S. Cl.
USPC ..... 347/16; 347/19; 347/104; 347/105

(58) Field of Classification Search
USPC ..... 347/16, 19, 105, 104
See application file for complete search history.

(56) References Cited

U.S. PATENT DOCUMENTS

| | | | | |
|---|---|---|---|---|
| 5,934,140 | A * | 8/1999 | Jackson et al. | 73/159 |
| 7,548,316 | B2 * | 6/2009 | Castillo et al. | 356/406 |
| 2010/0214348 | A1 * | 8/2010 | Miyahara | 347/19 |
| 2012/0256371 | A1 * | 10/2012 | Woodford | 271/265.02 |
| 2014/0092159 | A1 * | 4/2014 | de Jong et al. | 347/16 |

* cited by examiner

*Primary Examiner* — Sarah Al Hashimi

(57) ABSTRACT

A substrate media height detector for a printing system having a print head including a media transport having a surface for moving a sheet of substrate media along a media path in a process direction. An elongate detection member includes a portion extending across the media path in a cross-process direction and is spaced from the media transport surface a predetermined distance. The detection member is movably attached to a support structure and is deflectable upon engagement with a sheet of substrate media. A deflection sensor senses the deflection of the detection member by the substrate media.

21 Claims, 6 Drawing Sheets

EXCESSIVE SUBSTRATE MEDIA HEIGHT DETECTION IN A PRINTING APPARATUS

TECHNICAL FIELD

The presently disclosed technologies are directed to apparatus and methods used to determine the height of sheets in a media handling assembly, such as a printing system. The systems and methods described herein use a media height detecting member to determine if there is excessive media height and provide a response to protect contact sensitive elements of the printing system.

BACKGROUND

Printing systems include a printing device to impart an image on a substrate media. In direct printing systems, a print head is disposed adjacent the media and an image is directly transferred onto the media. One type of direct printing is a solid inkjet ("SIJ") system. A key critical dimension associated with the SIJ printing process is the small gap between the ink jet heads and the receiving media. This gap typically is on the order of 0.5 mm, and must be tightly controlled to maintain accurate drop placement which in turn results in acceptable image quality. In the case of web-based media handling systems, one can maintain this gap relatively easily with the proper geometry and web tension. However, for cut-sheet SIJ systems, the sheet edges pose a problem as the edges can be lifted up from a media transport, for example, electrostatic, vacuum, etc., due to curl. If these edges come into contact with the print heads during operation, damage to the jets could occur. As the print heads are expensive, this scenario would negatively impact run cost.

Solutions to this problem have included using a long range sensor which is mounted across the media path and used to detect the entire cross process length of the sheet in real-time at the inspection zone. The long range sensor can be a transmitter-receiver pair, retro-reflective type, or an array/curtain type. However, experience with these methods has revealed difficulties in obtaining parallelism to the transport zone, difficulties in transmitter/receiver pair alignment, etc. Also, secondary reflections due to beam parallelism error and beam divergence were major sources of noise.

Therefore, it is desirable to provide an apparatus which can reliably determine excessive media height to protect to contact sensitive devices.

SUMMARY

According to aspects described herein, there is disclosed a substrate media height detector for a printing system having a print head including a media transport having a surface for moving a sheet of substrate media along a media path in a process direction. An elongate detection member includes a portion extending across the media path in a cross-process direction and is spaced from the media transport surface a predetermined distance. The detection member is movably attached to a support structure and is deflectable upon engagement with a sheet of substrate media. A deflection sensor is disposed adjacent to the detection member for sensing the deflection of the detection member by the substrate media caused by engagement with the substrate media thereby indicating media having excessive height.

According to other aspects described herein, there is disclosed a direct marking printing system including at least one print head for imparting an image onto a media substrate. A media transport has a surface that moves a sheet of substrate media along a media path in a process direction past the print head. A media hold down holds the media against the media transport surface. A substrate media height detector includes an elongate detection member spaced a predetermined distance X from the media transport surface and extends over the media transport surface in a cross-process direction. The height detector is disposed upstream of a print head. A sensor is disposed adjacent to the detection member for sensing deflection of the detection member caused by engagement with the substrate media thereby indicating media having excessive height.

According to further aspects described herein, there is disclosed a method for protecting a print head in a printing system comprising:

transporting a sheet of media along a media path in a process direction;

detecting media exceeding a predetermined height with an elongate detection member including a portion extending across the media path in a cross-process direction and being spaced from the media transport surface a predetermined distance X, the detection member being movably attached to a support structure, the detection member being deflectable upon engagement with a sheet of substrate media; and sensing with a sensor the deflection of the detection member by sheet of media exceeding the predetermined height; and initiating a print head protection response responsive to the sensed deflection of the detection member wherein the sheet of media exceeding the predetermined height is prevented from engaging the print head.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
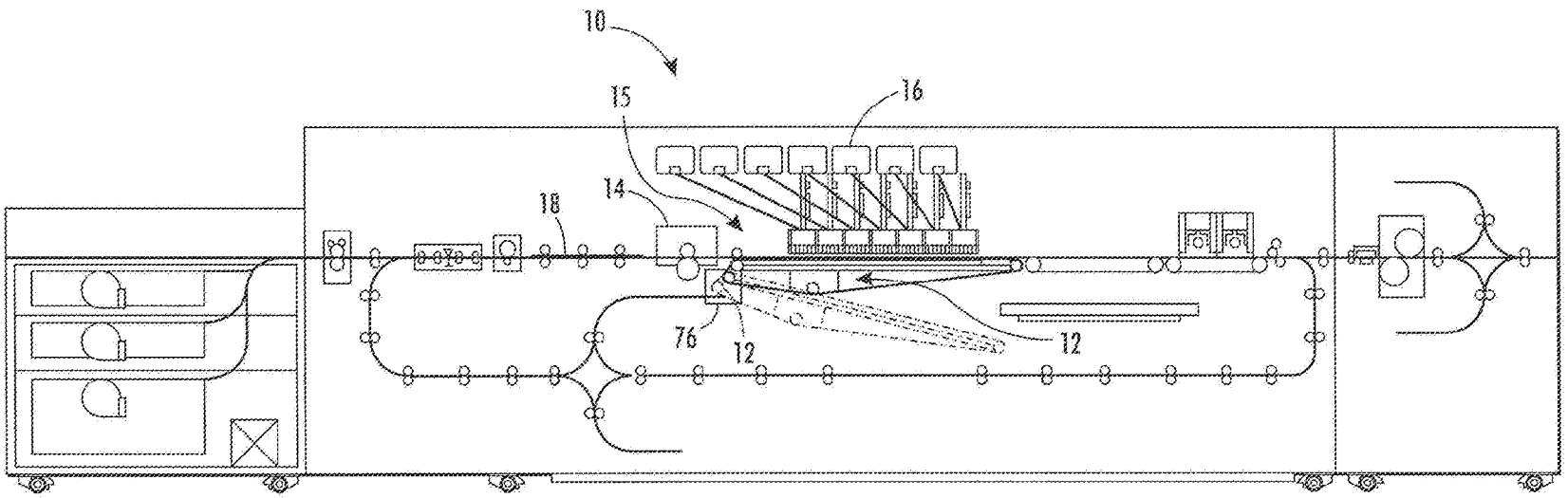
FIG. 1 depicts a schematic view of a printing system including a substrate media height detector

Describing now in further detail these exemplary embodiments with reference to the Figures.

As used herein, "substrate media" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in the process direction.

As used herein "media height" refers to the uppermost vertical distance the substrate media extends above a surface upon which it is supported. "Excessive media height" refers to media having a height exceeding a predetermined value. Excessive media height may cause the media to engage contact sensitive portions of the printing system such as the print heads.

As used herein, a "media transport" refers to one or more devices used for handling and/or transporting substrate media, including feeding, printing, finishing, registration and transport systems.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as refers to herein can include one or more point sensors and/or array sensors for detecting and/or measuring characteristics of a substrate media, such as speed, orientation, process or cross-process position and even the size of the substrate media. Thus, reference herein to a "sensor" can include more than one sensor.

As used herein, the terms "process" and "process direction" refer to a process of moving, transporting and/or handling a substrate media. The process direction substantially coincides with a direction of a flow path P along which the substrate media is primarily moved within the media handling assembly. Such a flow path P is said to flow from upstream to downstream. A "lateral direction" or "cross-process direction" is used interchangeably herein and both refer to at least one of two directions that generally extend sideways relative to the process direction. From the reference of a sheet handled in the process path, an axis extending through the two opposed side edges of the sheet and extending perpendicular to the process direction is considered to extend along a lateral or cross-process direction.

As used herein, a "printing system", "printer," or "printing assembly" refers to one or more devices used to generate "printouts" or a print outputting function, which refers to the reproduction of information on "substrate media" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate to record and reproduce information, or other suitable processes for generating printouts, such as an ink jet process, a liquid ink process, a solid ink process, and the like. Also, such a printing system can print and/or handle either monochrome or color image data.

Detection member as used herein refers to a device or element for that is used to determining the presence of an object.

A substrate media height detector as used herein refers to an apparatus that can determine if substrate media is of a certain height.

FIG. 1 shows an exemplary production printing system 10 includes a direct marking media transport system 12 having a media height detector 14. The media height detector is disposed upstream of a print zone 15 including one or more print heads 16 for imparting an image on the media. If excessive substrate media height is detected, corrective action can be taken to avoid print head damage.

Figure 2:
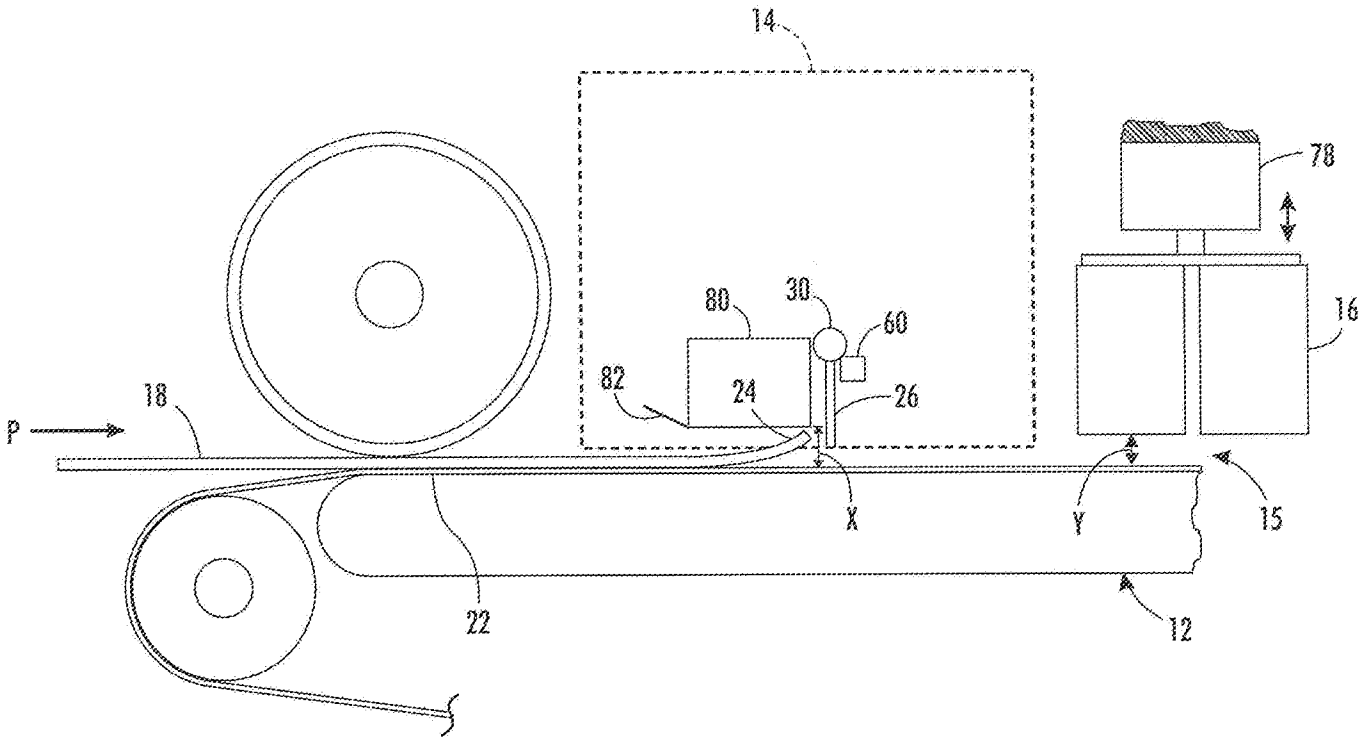
FIG. 2 depicts a schematic view of the substrate media height detector.

With additional reference to FIG. 2, media 18 is transported onto a hold-down transport 20 using a traditional nip based registration transport with nip releases (not shown). The hold down transport 20 may include a media transport surface 22 on which the substrate media 18 is supported. The media transport surface 22 may include a belt such as a vacuum belt of a type known in the art. Alternatively, or in addition to the vacuum, an electrostatic charge may be used to hold down the media in a flat configuration in preparation for receiving an image. After a media lead edge 24 is acquired by the hold-down transport, the media is transported along a media path in a process direction P toward the media height detector 14.

Figure 3:
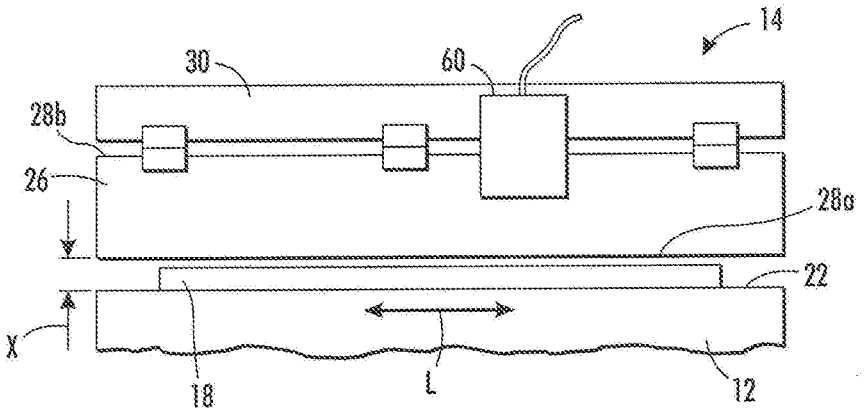
FIG. 3 depicts a front elevational view of the substrate media height detector.
Figure 4:
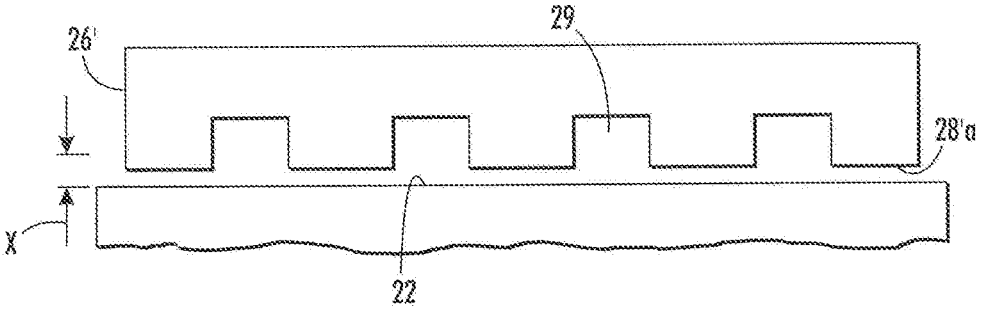
FIG. 4 depicts a front elevational view of an alternative embodiment of a detection member.

With additional reference to FIG. 3, the media height detector 14 may include an elongate detection member 26 having substantially straight, opposed first and second edges 28*a* and 28*b*. The first edge 28*a* extends over and is spaced a controlled distance from the media transport surface 22 in a cross-process direction L. The detection member may have accurate straight edges (<=0.001 inch accuracy). The first edge 28*a* opposed form the media transport surface elongate detection member 26 may have a continuous and interrupted edge such as the edge of a ruler. In an alternative embodiment shown in FIG. 4, the detection member 26' may have a first edge 28*a* which may have interruptions such as a plurality of gaps 29 as shown in FIG. 4. The detection member 26 may be made of a metal such as steel or aluminum, or of a polymer. The detection member is a relatively flat member shaped like a straightedge having a width less than its length and has a thickness significantly less than either the length or width.

Figure 5:
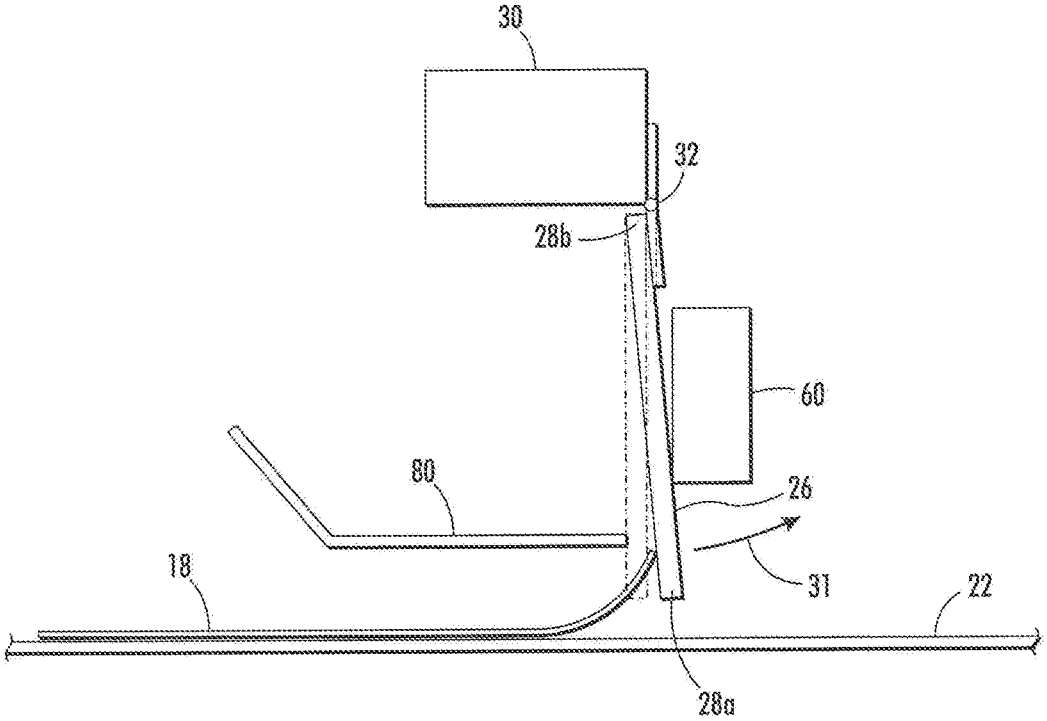
FIG. 5 depicts a schematic view of the substrate media height detector with a sheet of substrate media engaging the detector.

With further reference to FIGS. 3 and 5, the detection member 26 may be movably attached to a support structure 30. If the detection member is engaged by a sheet of media 18, the detection member 26 will deflect (as indicated by arrow 31 in FIG. 5), thereby indicating the media 18 has an excessive height. The support structure 30 may be a portion of the housing or frame of the media height detector 14. The manner of attachment may include a hinge 32 secured adjacent the detection member second edge 28*b* such that the detection member 26 may pivot with respect to the support structure 30 if engaged by a sheet of media. It is further contemplated that the detection member 26 may be mounted to the support structure 30 by other mounting devices that permit the member to deflect when engaged by a sheet of media 18. Such mounting configurations include, but are not limited to, hinged, clamped or suspension mounts.

With reference to FIGS. 2 and 3, the detection member first edge 28*a* opposed from the media transport surface 22 may be spaced a predetermined distance X from the surface. The space between the detection member and the media transport surface define a space though which media having acceptable height may pass. In the embodiment of the detection member having gaps 29, the distance X is the distance from the bottom edges of the detection member to the surface 22, as shown in FIG. 4. This distance is preferably constant over the length of the detection member 26. Due to the accuracy of the first edge 28*a*, the distant X may be held relatively constant over the entire length of the detection member. The distance X is preferably less than a distance Y between the media transport surface and the face of the print heads. Accordingly, if the media 18 can pass below the detection member 26 without engaging it, the media will pass thought the print zone 15 without engaging the print heads 16. In an exemplary embodiment, the distance X may be in the range of 0.3 mm to 1.0 mm which may depend, in part, on the thickness of the media. The distance Y may be in the range of 0.5 mm to 1.2 mm for example.

Figure 6:
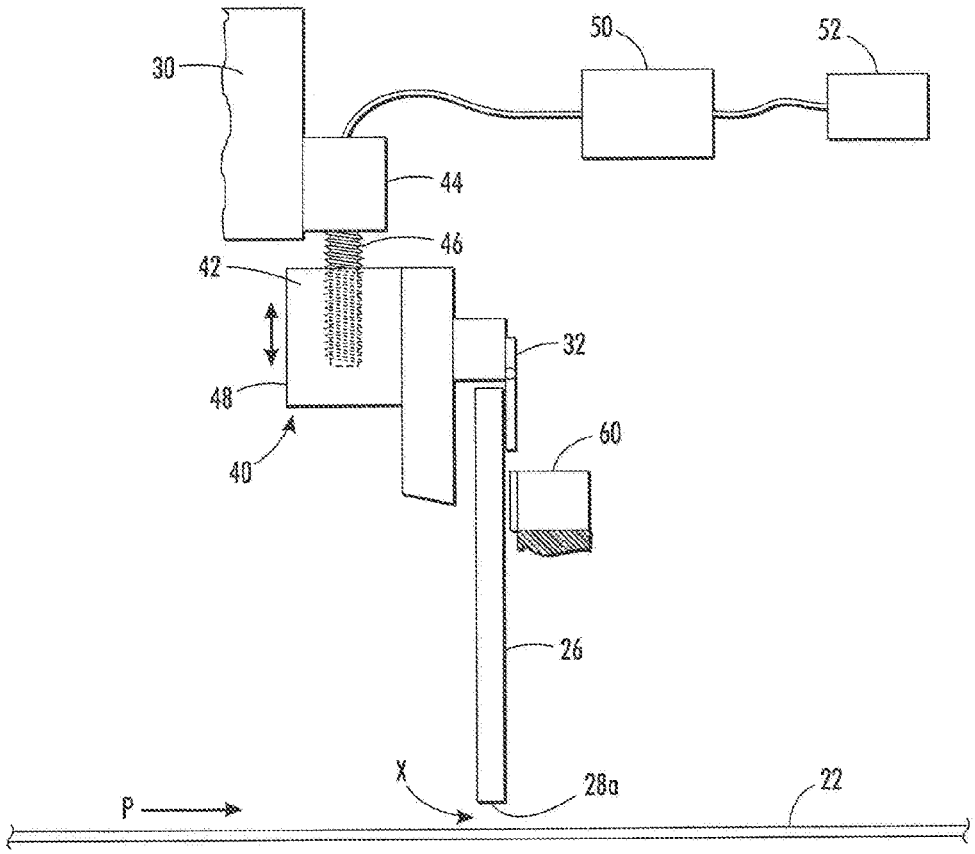
FIG. 6 depicts a side elevational view of a substrate media height detector adjustment mechanism.

With reference to FIG. 6, the substrate media height detector 14 may further include a sheet thickness adjuster 40. The adjuster 40 may change the distance X in response to substrate media thickness, e.g., the thicker the media 18 the greater the distance X. The adjuster may include a motorized mount 42 disposed between the support structure 30 and the detection member 26 to that the detection member can adjusted up and down relative to the media transport surface 22. The mount 42 may include a motor 44 driving a threaded member 46 that threadingly engages an internally threaded block 48. The threads may have a very fine pitch and the motor may be a stepper motor to permit fine adjustments of the detection member. By activating the motor 44 and turning the threaded member 46, the detection member 26 can be moved closer or further from the media transport surface 22. Alternatively, the support structure 30 itself may be movable to allow the detection member to move with respect to the media transport surface.

The sheet thickness adjuster 40 may be operably connected to an adjustment controller 50 which is operably connected to a sheet thickness input 52. The adjustment controller 50 may cause the motorized mount to move the detection member 26 thereby changing the distance X in response to the value of the sheet thickness. The sheet thickness input may be a manual input entered by an operator. Alternatively, the input may be a signal received from a sheet thickness sensor (not shown) located upstream of the adjuster 40.

With reference to FIGS. 5 and 6, when a sheet of media 18 having excessive height engages and deflects the detection member, such deflection is picked up by a deflection sensor 60. A deflection sensor 60 is disposed in relation to the detection member so that the deflection can be sensed. In one embodiment, the deflection sensor 60 may be disposed on the downstream side of the detection member so that when the media engages the detection member, the sensor 60 is impacted. However, it is further contemplated that the sensor 60 may be disposed on the upstream side of the detection member. The deflection sensor 60 may of a type known in the art and include such sensors that sense strain, optical, capacitive or other physical phenomena. Alternatively, the sensor may be a micro-switch activated by the deflected detection member. When the substrate media 18 is transported past the media height detector if the leading edge of the media, for example, engages the detection member 26 it will deflect in the downstream direction. The deflection sensor 60 senses this deflection and generates a responsive signal. This signal indicates an excessive media height condition in which the media exceeds a predetermined acceptable height for entry to the print zone 15.

Figure 7:
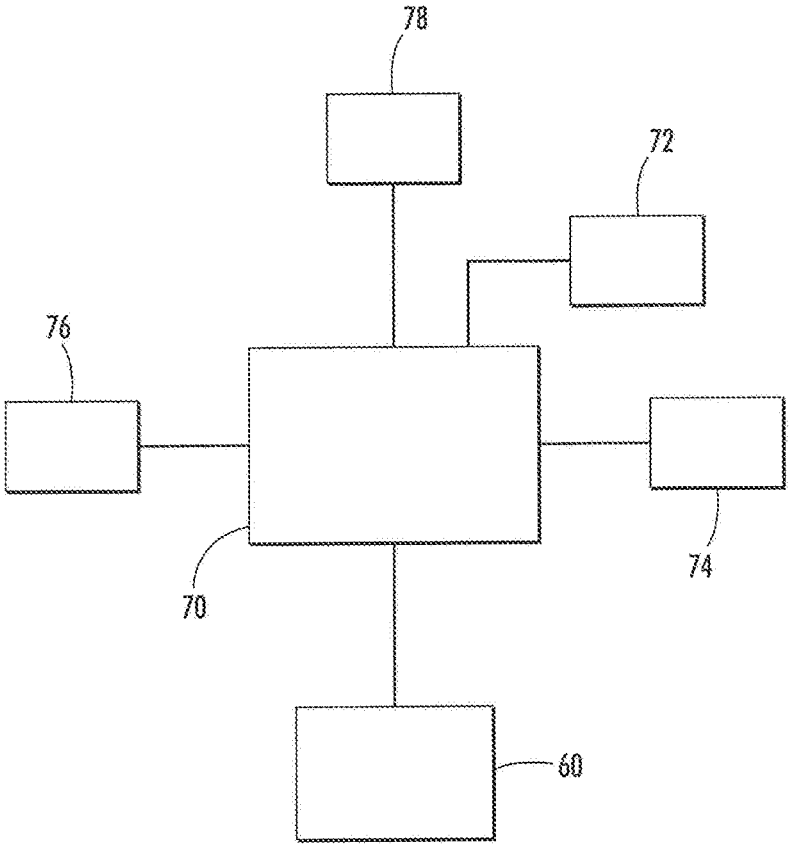
FIG. 7 depicts a schematic of a substrate media height detector control system.

With reference to FIG. 7, the signal may be communicated to a print head protection controller 70. The print head protection controller 70 may be integrated with, or separate from, the adjustment controller 50 described above. The transport controller 70 may include a processor, hardware, and software use to carryout the controller functions.

In response to the deflection sensor 60 signal, the controller 70 implements a response condition to protect the print heads 16. The response condition may prevent the media having excessive height from passing through the print zone 15 thereby avoiding damage to the print heads 16. In one embodiment, the controller 70 may generate output signals that cause the hold-down transport 20 to come to a stop, thereby preventing the media 18 from entering the print zone. To achieve this response condition, the controller 70 may be operably connected to a hold down transport drive 72 (FIG. 1) which would be deactivated to prevent further progress of the media 18. In such a case, an error message may then be generated and shown on a display 74 to alert an operator of the condition. An operator may then remove the media 18 from the printing system 10 and resume the print job.

In another embodiment, the controller 70 may be operably connected to a media transport position actuator 76 (FIG. 1). The actuator 74 can adjust the position of the transport surface 22 relative to the print heads 16 thereby increasing the distance between the print faces and transport surface to Y+n. Accordingly, if an excessive media condition is detected, the controller 70 will implement a response condition causing the actuator 74 to lower the transport surface 22 away from the print heads 16, thereby altering the path of the media 18 away from the print heads. As shown in FIG. 1, the hold-down transport 20 may be pivoted away from the print heads 16 to prevent the sheet having excessive height from engaging the print heads.

As alternative or addition to the use of the media transport position actuator, the controller 70 may be operably connected to a print head adjustment mechanism 78, which can move the print heads 16 toward and away from the sheet hold-down transport 20. When excessive media height is detected, the controller 70 may generate a response condition activating the print head adjustment mechanism 74 to move the print heads, thereby increasing the distance Y between the print head faces and sheet transport surface. The media 18 having excessive height may then pass downstream free and clear of the print heads 16. Preferably no printing would occur on this sheet. After the sheet with excessive height passes the print heads, the space between the face of the print heads and the media transport surface may be restored to the original distance Y.

In a further embodiment, the output of the controller could operate a diverter gate (not shown) which would divert the sheet of media 18 to an alternate path thereby bypassing the print zone 15.

With reference to FIG. 2, in a further embodiment, the substrate media height detector 14 may include a constraining baffle 80. The baffle 80 may include a surface 82 that tends to guide and urge the media 18 toward the transport surface 22. This gives a degree of stiffness to the media leading edge thus producing a larger force and displacement of the detection member 26 which is more easily detected by the deflection sensor 60 in the presence of noise.

While the substrate media height detector is describe herein for the protection of print heads, it is further contemplated that the height detector could be employed to protect other sensitive elements in a printing system that may be damaged or otherwise negatively affected by engagement with a sheet of media.

It will be appreciated that various of the above-disclosed and other features and functions, or alternatives thereof, may be desirably combined into many other different systems or applications. It will also be appreciated that various presently unforeseen or unanticipated alternatives, modifications, variations, or improvements therein may be subsequently made by those skilled in the art which are also intended to be encompassed by the disclosed embodiments and the following claims.

What is claimed is:

1. A substrate media height detector for a printing system having a print head comprising:

a media transport having a surface for moving a sheet of substrate media along a media path in a process direction;

an elongate detection member including a portion having a length extending across the media path in a cross-process direction a distance spanning a width of the sheet of substrate media and the length of the detection member being greater than its width and thickness, and having a longitudinally extending edge being spaced from the media transport surface a predetermined distance, the detection member being movably attached to a support structure, the detection member being deflectable upon engagement with a sheet of substrate media; and a deflection sensor disposed adjacent to the detection member for sensing the deflection of the detection member by the substrate media caused by engagement with the substrate media thereby indicating media having excessive height.

2. The substrate media height detector as defined in claim 1, wherein the detection member has a substantially straight edge spaced from the media transport surface.

3. A substrate media height detector as defined in claim 1, wherein the detection member is pivotally attached to the support structure.

4. The substrate media height detector as defined in claim 3, wherein the detection member is a substantial flat member having an attachment edge extending along a length thereof opposite from the straight edge, the attachment edge being pivotally connected to the support structure.

5. The substrate media height detector as defined in claim 1, wherein the media transport surface stops movement of the media having excessive height in response to the sensed deflection of the detection member.

6. The substrate media height detector as defined in claim 1, further including a print head protection controller operably connected to the sensor and a media transport surface actuator, wherein the controller causes the actuator to move the transport surface away from the print head in response to the sensed deflection of the detection member.

7. The substrate media height detector as defined in claim 1, further including a height adjustment mechanism operably connected to the detection member, the height adjustment mechanism changing the distance between the detection member and the media transport surface in response to a sheet thickness.

8. The substrate media height detector as defined in claim 7, wherein the height adjustment mechanism is operably connected to an adjustment controller, the adjustment controller generating a signal.

9. The substrate media height detector as defined in claim 1, including a controller operably connected to the deflection sensor, the controller generating an excessive height response to prevent media having excessive height from passing by the print head.

10. A direct marking printing system comprising:

at least one print head for imparting an image onto a media substrate;

a media transport having a surface for moving a sheet of substrate media along a media path in a process direction past the print head;

a media hold down for holding media against the media transport surface;

a substrate media height detector including an elongate detection member spaced a predetermined distance X from the media transport surface and extending over the media transport surface in a cross-process direction, wherein the value of the distance X is responsive to the thickness of the substrate media, the height detector being disposed upstream of a print head; and a sensor disposed adjacent to the detection member for sensing deflection of the detection member, wherein engagement of the detection member by the substrate media indicates media having excessive height.

11. The direct marking printing system as defined in claim 10, wherein the distance X is the same or less than a space between the print head and the media transport surface.

12. The direct marking printing system as defined in claim 10, wherein the detection member is movably secured to a support structure.

13. The direct marking printing system as defined in claim 10, wherein the detection member is pivotally secured to the support structure.

14. The direct marking printing system as defined in claim 10, wherein the detection member is a generally flat member having an edge extending over the media transport surface in a cross-process direction, the edge and media transport surface defining a space through which media may pass.

15. The direct marking printing system as defined in claim 10, further including a print head protection controller for influencing the transport of media in response to a signal generated by the deflection sensor indicating media having excessive height.

16. The direct marking printing system as defined in claim 15, wherein the print head protection controller is operably connected to the deflection sensor and operably connected to a media transport drive, wherein the controller causes the drive to be deactivated, thereby stopping further transport of the media, in response to a signal generated by the deflection sensor.

17. The direct marking printing system as defined in claim 15, wherein the print head protection controller is operably connected to an actuator for moving the transport surface way from and toward the print head, and the actuator moves the media transport surface away from the print head in response to the sensor indicating excessive media height.

18. A method of protecting a print head in a printing system comprising:

transporting a sheet of media along a media path in a process direction;

detecting media exceeding a predetermined height with an elongate detection member including a portion extending across the media path in a cross-process direction and being spaced from the media transport surface a predetermined distance X, the detection member being movably attached to a support structure, the detection member being deflectable upon engagement with a sheet of substrate media; and sensing with a sensor the deflection of the detection member by sheet of media exceeding the predetermined height; and initiating a print head protection response responsive to the sensed deflection of the detection member wherein the sheet of media exceeding the predetermined height is prevented from engaging the print head, wherein the print head protection response includes one of stopping the transport of the media, changing the position of the transport path, and changing the position of the print head.

19. A substrate media height detector for a printing system having a print head comprising:

a media transport having a surface for moving a sheet of substrate media along a media path in a process direction;

an elongate detection member including a portion extending across the media path in a cross-process direction and being spaced from the media transport surface a predetermined distance, the detection member being movably attached to a support structure, the detection member being deflectable upon engagement with a sheet of substrate media; and a deflection sensor disposed adjacent to the detection member for sensing the deflection of the detection member by the substrate media caused by engagement with the substrate media thereby indicating media having excessive height, wherein the media transport surface stops movement of the media having excessive height in response to the sensed deflection of the detection member.

20. A substrate media height detector for a printing system having a print head comprising:

a media transport having a surface for moving a sheet of substrate media along a media path in a process direction;

an elongate detection member including a portion extending across the media path in a cross-process direction and being spaced from the media transport surface a predetermined distance, the detection member being movably attached to a support structure, the detection member being deflectable upon engagement with a sheet of substrate media;

a deflection sensor disposed adjacent to the detection member for sensing the deflection of the detection member by the substrate media caused by engagement with the substrate media thereby indicating media having excessive height; and a controller operably connected to the deflection sensor, the controller generating an excessive height response to prevent media having excessive height from passing by the print head.

21. The substrate media height detector as defined in claim 20, wherein the controller stops movement of the media having excessive height in response to the sensed deflection of the detection member.

* * * * *